US005951123A

United States Patent [19]

Bomstad et al.

[11] Patent Number: 5,951,123

[45] Date of Patent: Sep. 14, 1999

[54] GUARD ASSEMBLY FOR A WHEEL

[75] Inventors: Don W. Bomstad, Earlville; Eric R. O'Brien, Sugar Grove, both of Ill.

[73] Assignee: Caterpillar Inc., Peoria, Ill.

[21] Appl. No.: 09/007,871

[22] Filed: Jan. 15, 1998

[51] Int. Cl.[6] ..... B60B 19/02

[52] U.S. Cl. ..... 305/107; 172/112; 305/100

[58] Field of Search ..... 305/100, 107–110, 305/115; 302/37.1, 6.1, 6.3; 404/129; 172/112, 610

[56] References Cited

U.S. PATENT DOCUMENTS

| | | | |
|---|---|---|---|
| 4,818,040 | 4/1989 | Mezzancella et al. | 305/110 |
| 5,330,260 | 7/1994 | Freeman | 305/110 |
| 5,370,451 | 12/1994 | Brownlee et al. | 305/100 |
| 5,553,932 | 9/1996 | Freeman | 305/107 |
| 5,733,020 | 3/1998 | McCartney et al. | 305/107 |
| 5,820,230 | 10/1998 | Freeman | 305/107 |

OTHER PUBLICATIONS

Caterpillar Product Information Newsletter—Dated Dec. 1995—834B Wheel Dozer, 836 Landfill Compactor.

Caterpillar Service Letter—Product Improvement Program for Adding Conical Discs to the Wheels on Certain 836 Compactors—Jun. 24, 1996.

*Primary Examiner*—D. Glenn Dayoan
*Assistant Examiner*—Long Bao Nguyen
*Attorney, Agent, or Firm*—William C. Perry

[57] ABSTRACT

In the operation of a construction machine over terrain strewn with debris, there is a tendency for the debris to work itself into areas of sealing interface such as between an axle and the final drive assemblies of the machine. When this occurs the seals and possible the life of the drive components can be greatly reduced. The present invention comprehends a guard assembly that has a bracket member that is positioned on an axle adjacent a cylindrical hub defined by the wheels. The guard assembly utilizes a plurality of plates positioned within, above and laterally spaced from the hub of an adjacent wheel to prevent the ingress of foreign material into the hub. The hub and the sealed interfaces and other components housed therein are thereby protected from possible damage as a result of contact with the foreign material.

16 Claims, 4 Drawing Sheets

GUARD ASSEMBLY FOR A WHEEL

TECHNICAL FIELD

This invention relates to a guard assembly and more particularly to a guard assembly for a wheel assembly that is rotatably mounted to an axle assembly.

BACKGROUND ART

In the operation of construction machines, it is a common practice to operate over terrain that is littered with foreign material and various types of debris. In fact, in the type of machine known as a landfill compactor, the intended purpose is to maneuver over trash and refuse to "compact" the material, so that more material may be brought in to the landfill and the most efficient use of the available land is attained. In doing so, it is a common and vexatious problem to encounter the wrapping of wire, cable, hoses, textile material, long strips of plastic and other strands of material around the wheels and axles of the machines. Not only does this require frequent and costly machine maintenance to continually remove this material, the strands of material may be drawn tightly around the axle or even layered around it. When this happens, the strands tend to find their way into the area of the hubs of the wheels. This is an area where the final drive or other rotating axle components are located, forming a sealed interface with the stationary, or non-rotating axle housing. In many instances, the wrapped material will become lodged in the area of this sealed interface. When this happens destruction of the seals is likely to occur and, if operation of the machine continues in this condition, destruction of one or more of the drive components can also result.

In some instances, it has been known to provide an external cylindrical portion that extends outwardly from the recess to encompass the entire axle assembly. While this has been known to provide some relief, the open end portion around the axle will still allow wire and cable to be wound around the axle and work itself into the area of the seal interface. In addition, since the outer cylindrical extension surrounds the axle the same distance below as above, the ground clearance is greatly reduced, causing the axle assembly to pick even more debris.

The present invention is directed to overcoming one or more of the problems set forth above.

DISCLOSURE OF THE INVENTION

In one aspect of the present invention a guard assembly for a compactor wheel is provided. The guard assembly includes a housing and a wheel that is mounted to the housing for relative rotation with respect thereto. The wheel has an inner cylindrical portion defining a cylindrical recess, an outer drum and a pair of side walls positioned to extend radially therebetween. The wheel is mounted on the housing such that a portion of the housing is positioned within the cylindrical recess. A bracket assembly is included that has a first segment that is generally cylindrical in configuration. A second, generally semi-cylindrical segment is positioned to extend from an upper portion of the first segment. The bracket assembly is adapted for mounting on the housing in a manner wherein the first segment is positioned within the inner cylindrical recess of the wheel and the second segment is positioned outwardly of the cylindrical recess to restrict the ingress of foreign material into the cylindrical recess.

In another aspect of the present invention, a guard assembly is provided for an axle assembly. The axle assembly has a pair of end portions and a final drive assembly mounted to each of the respective end portions for relative rotation with respect thereto. A pair of wheels is included, each having a hub portion defining a generally cylindrical recess. Each wheel is mounted to each final drive assembly for rotation therewith about an axis. A bracket assembly is mounted on the respective end portions of the axle assembly adjacent the respective wheels. Each bracket assembly has a mounting bracket that has a first and second side are mounted to the end portions of the axle assemblies. A generally semi-cylindrical plate member is mounted to the first side of the mounting bracket and is positioned to extend into the cylindrical recess of the adjacent hub portion. The semi-cylindrical plate member is positioned adjacent a lower portion of the cylindrical recess in concentric, closely spaced relation thereto. A shroud member has a generally semi-cylindrical configuration and first and second portions and is secured to the mounting bracket with the first portion thereof in complementary adjacent relationship to the semi-cylindrical plate member to define a generally cylindrical segment therewith. The shroud member is positioned with the first portion thereof within an upper portion of the adjacent cylindrical recess in concentric, closely spaced relationship thereto and the second portion thereof axially spaced from the first portion in overlying relation to the mounting bracket and the axle assembly.

With the guard assembly as set forth above, the ingress of foreign matter from virtually and direction surrounding the wheels is substantially eliminated. In doing so, not only is the down time associated with the continued clean up of this area greatly reduced, risk of damage to the sealed interface between the final drive and the axle housing is also substantially eliminated.

BEST MODE FOR CARRYING OUT THE INVENTION

Figure 1:
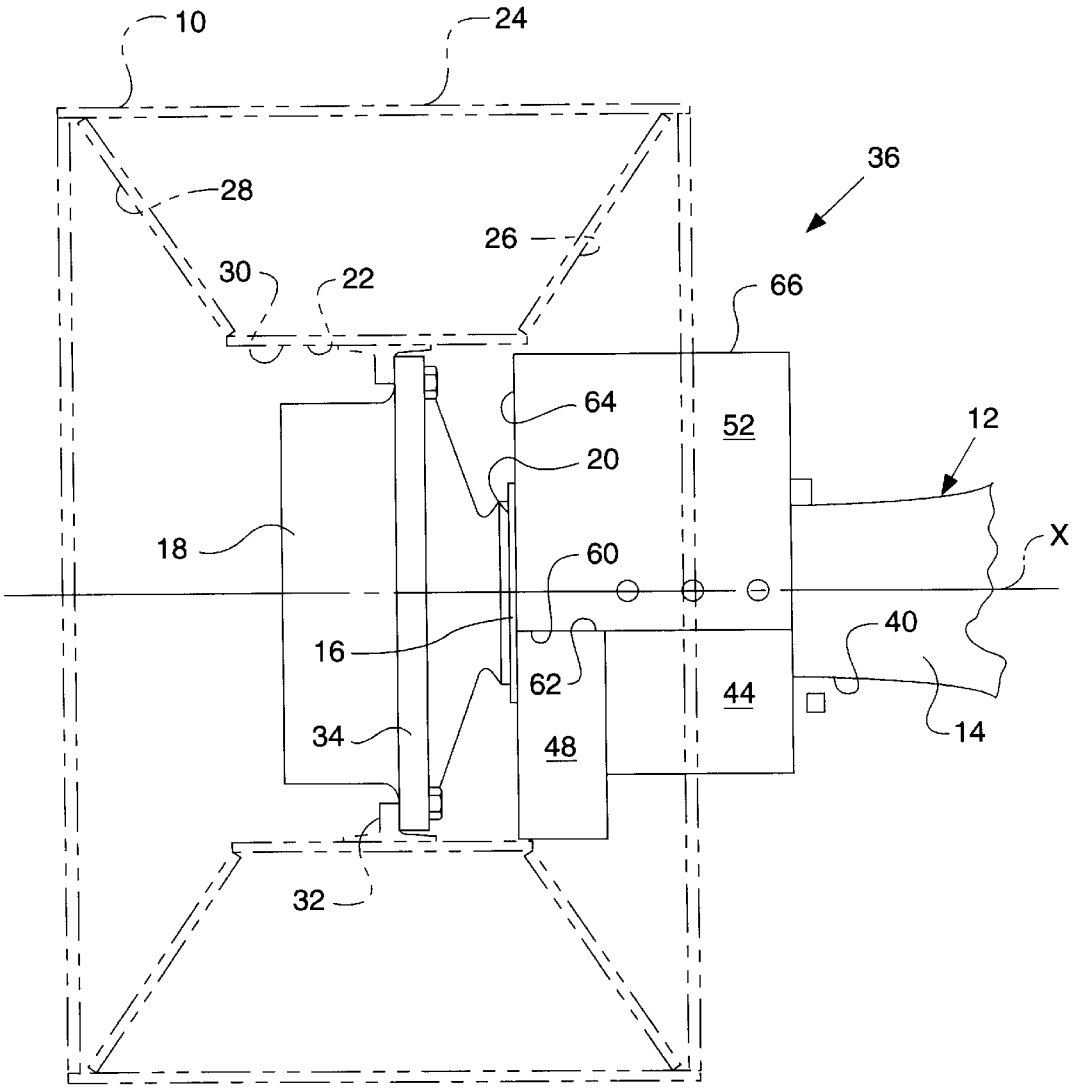
FIG. 1 is a diagrammatic side view, shown in partial section, of a portion of an axle assembly having a guard assembly that embodies the principles of the present invention.
Figure 2:
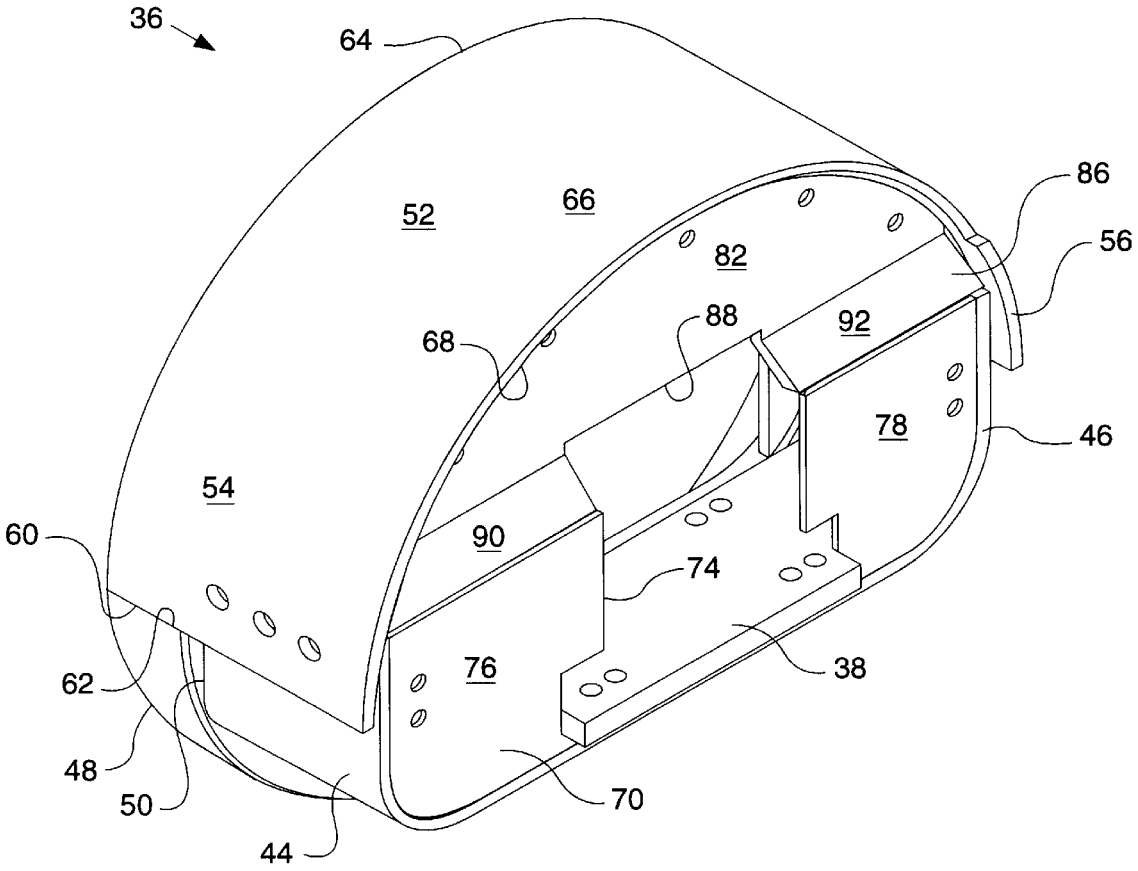
FIG. 2 is a diagrammatic isometric view of the guard assembly without the surrounding structural components.

Turning now to the drawings, it can be seen that a wheel 10 is shown to be rotatably mounted on an axle assembly, shown generally at 12. The axle assembly 12 is of a well known design and typically includes an outer housing 14 that is substantially stationary (non-rotatable) and is mounted to a frame (not shown) of a machine (not shown). For the sake of brevity, only one end portion of the axle assembly is shown and described in detail herein, it being understood that both ends of the axles are substantially identical. The axle assembly 12 defines a first end portion 16 that rotatably mounts a drive mechanism such as a final drive 18 about an axis of rotation X. Since the final drive rotates with respect to the axle housing, a sealed interface 20 (FIG. 1) must be established to keep debris from entering the axle housing and to keep lubricating oil from exiting.

The wheel 10 defines a hub portion 22 that is defined by an inner cylindrical portion, and a drum 24 that is adapted for engaging the terrain. The drum 24 is supported on the hub 22 by a pair of inner and outer side plates 26 and 28 that extend radially between the hub and the drum. The hub defines a generally cylindrical recess 30 and has a mounting flange 32 defined within the recess along a mid section thereof. The mounting flange 32 engages a mounting flange 34 of the final drive 18 and is secured thereto by a plurality of fastening members to mount the wheel for rotation with the final drive. It can be seen that the end portion 16 of the axle assembly 12 is positioned within the recess 30 and the sealed interface 20 is in turn, positioned between the end portion of the axle and the mounting flange 32 of the wheel 10.

Figure 3:
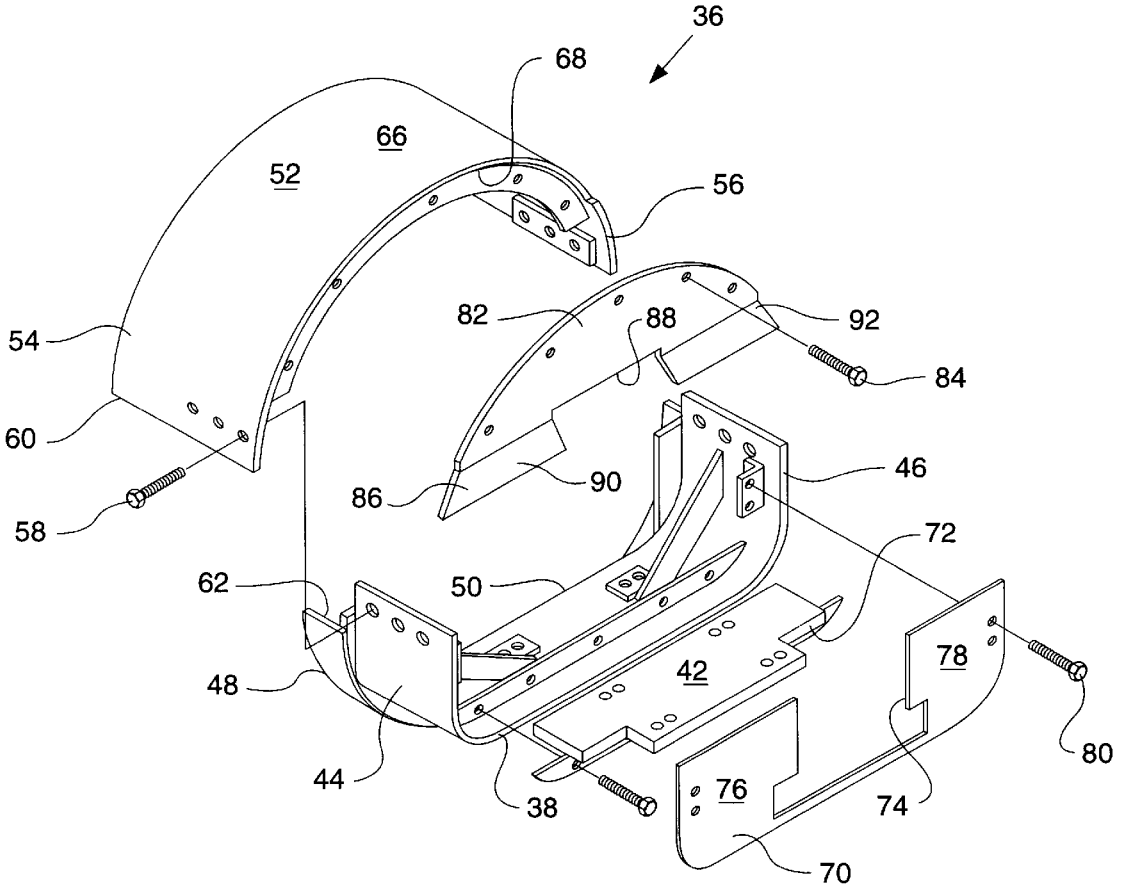
FIG. 3 is a diagrammatic exploded view of the guard assembly shown in FIG. 2.
Figure 4:
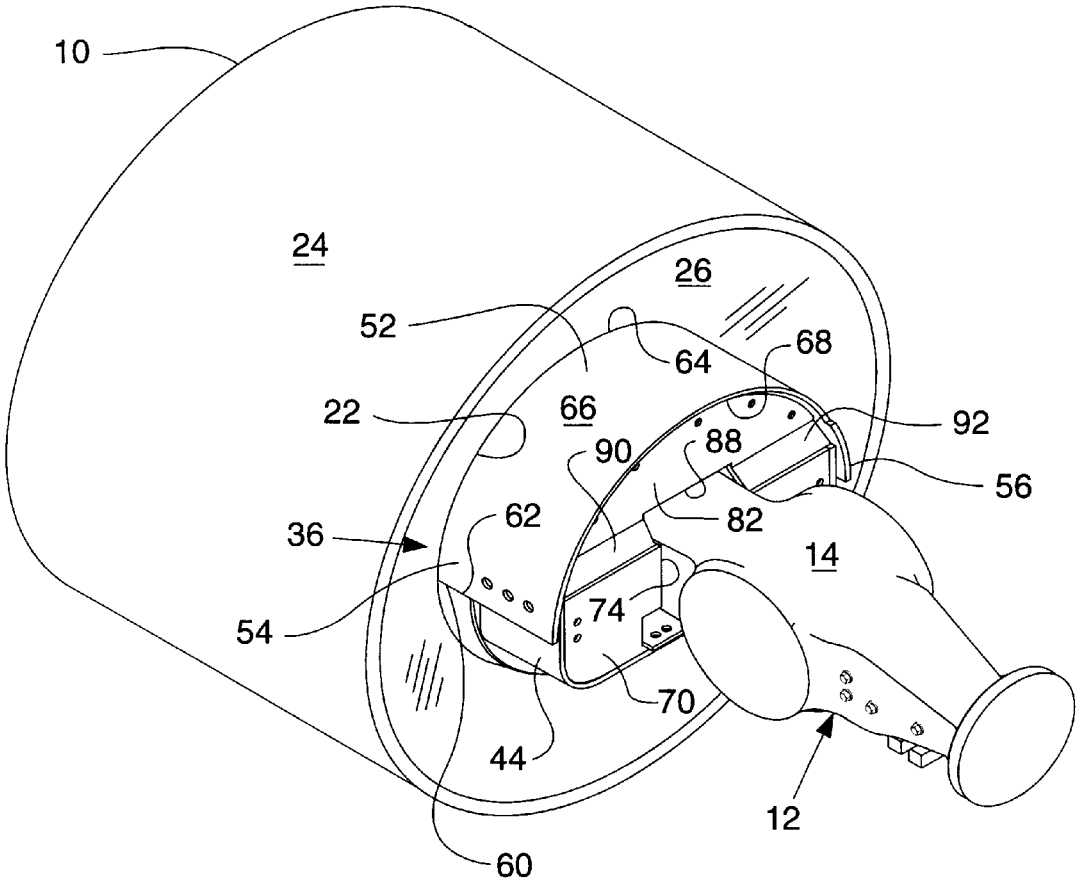
FIG. 4 is a partial, diagrammatic, isometric view of a wheel and axle assembly taken from a point that is inboard the wheel assembly with the guard assembly in the installed condition.

A bracket assembly, shown generally at 36, is mounted to the end portion 16 of the axle assembly 12. The bracket assembly includes a base, or mounting bracket 38 that is mounted to the underside 40 of the axle assembly 12 by any suitable attachment means such as threaded fasteners or by welding. As can best be seen in FIG. 3, the mounting bracket has a generally planar mid portion 42 that engages the axle assembly. A pair of upwardly extending flanges 44 and 46 are defined by the mounting bracket and are positioned on opposing sides of the axle assembly. A generally semi-cylindrical plate 48 is secured to a first side 50 of the mounting bracket 38 by any suitable means or may be integrally formed therewith. The mounting bracket and plate 48 are mounted on the axle assembly so that the plate is positioned within the lower portion of the cylindrical recess 30 defined by the wheel and is substantially centered about axis X and is therefore concentric with the cylindrical recess 30. The radius of the plate 48 is such that it is only slightly smaller than that of the recess 30 so as to provide a very small space therebetween. The concentric positioning of the plate 48 coupled with the slightly reduced radius allows relative rotation between the wheel 10 and the plate 48 without interference.

A shroud member 52 having a generally semicircular configuration is mounted to the mounting bracket 38 in overlying relationship thereto. A first end portion 54 of the shroud is secured to the flange 44 of the mounting bracket while a second end portion 56 of the shroud 52 is secured to the flange 46. Threaded fasteners 58 (FIG. 3) are shown to mount the shroud to the mounting bracket however any suitable attachment means may also be used. The radius of the shroud 52 is substantially equal to that of the plate 48. The shroud is positioned on the mounting bracket such that an outboard portion 60 of the shroud engages an upper portion 62 of the plate 48 in a complementary fashion to complete a continuous cylindrical segment 64 that extends into the recess 30. The remainder or second portion 66 of the shroud 52 extends axially, in an inboard direction, from the cylindrical segment 64 and defines a semi-cylindrical segment 68 that overlies the mounting bracket 38 and the upper portion of the axle assembly. Like the plate 48 on the lower portion of the recess 30, the shroud is substantially centered about axis X, and the radius of the shroud 52 is such that is it only slightly smaller than that of the recess. This configuration permits the wheel hub 22 to rotate with respect to the cylindrical segment 64 formed by the plate 48 and the shroud 52 while permitting a very small gap therebetween.

A first cover member or plate 70 is mounted to a second side 72 (FIG. 3) of the bracket assembly 38 and extends transversely with respect to the hub 22 or perpendicular to the axis X. The first cover plate 70 defines an opening 74 along a central portion thereof that divides the plate 70 into a pair of side portions 76 and 78 that are positioned on opposite sides of the axle assembly 12. The opening 74 is sized to be only slightly larger than the width of the axle assembly to leave a space of a preselected width therebetween. The first cover plate 70 is mounted to a pair of internal flanges defined by the bracket assembly 38 by a plurality of threaded fasteners 80 or any other suitable means.

A second cover member, or plate 82 is positioned between and mounted to one or both of the shroud 52 and the first cover plate 70. In the illustrated embodiment, the second cover plate 82 is secured to the second portion 66 of the shroud by means of fasteners 84 or any other suitable means. The second cover plate 82 defines an angled portion 86 that is directed toward and is positioned for engagement with the first cover plate 70. Like the first cover plate, the second cover plate 82 extends transversely across the mounting bracket, perpendicular to the axis X. The second cover plate 82 defines an opening 88 in a central portion thereof that is aligned with the opening 74 defined in the first cover plate 70. The opening 88 divides the second cover plate 82 into a pair of downwardly projecting side portions 90 and 92 that are positioned on opposing sides of the axle assembly. The opening 88 is sized to be only slightly larger than the width of the axle assembly to leave a space of a preselected width therebetween. The openings 74 and 88 combine to define an aperture that totally surrounds the axle assembly allowing only a small space of a preselected size to extend therebetween.

While the guard assembly is shown and described to be a compilation of plates mounted together in a specific array, it is to be understood that one or more of these plates could be combined into a single component without departing from the intent of the subject invention.

INDUSTRIAL APPLICABILITY

During operation of a machine such as a landfill compactor, teeth, normally defined on the drum 24 of the wheels 10 may pick up debris of all kinds which will tend to fall on the inboard side of the wheel. As it does so, it will fall on the second portion, or semi-cylindrical portion 66 defined by the shroud 52 of the mounting bracket 38. Being rounded as it is, there is a natural tendency for the material to fall from atop the bracket assembly back to the ground and not remain on the axle assembly.

In many instances, the material picked up will be wire, cable or other strands of various material, which the wheels will tend to carry around the axle assembly 12 as they rotate thereabout. When this occurs, the substantially smooth surface provided by the mounting bracket 38 and the shroud 52 reduce the number of edges that strands of material tend to catch and hold, thus initiating the winding of the material around the axle. Without sharp edges to catch on, the strands of material will be more likely to fall back to the ground. Should the wrapping of the material occur however, the guard assembly will prevent the material from working its way into the cylindrical recess where it would otherwise have a chance to affect the sealing interface between the wheel and the final drive or any other components.

In addition, as the machine traverses the landfill, the mounting bracket 38 upon which the guard assembly is mounted is substantially positioned up out of the debris since in relatively planar mounting bracket is the only thing that extends below the axle assembly 12. This in turn, positions the majority of the bracket assembly either within the recess or above the axle assembly. Being so positioned, the ground clearance of the machine is substantially unaffected.

With a guard assembly as set forth above, protection for a wheel and/or axle assembly is afforded from virtually every direction. The shroud prevents material from entering the cylindrical recess from above while the semi-cylindrical plate 48 positioned within the recess restricts ingress from beneath the axle. The first and second cover plates 70 and 82 work in conjunction with one another to restrict ingress of foreign material from an axial direction through axle wrapping or the packing of debris between the frame and the wheel.

Other aspects, objects and advantages of this invention can be obtained from a study of the drawings, the disclosure and the appended claims.

We claim:

1. A guard assembly for a compactor wheel, comprising:

a housing;

a wheel having an inner cylindrical portion defining a cylindrical recess, an outer drum and a pair of side walls positioned to extend radially therebetween, said wheel being mounted to the housing for relative rotation with respect thereto, with a portion of the housing being positioned within the cylindrical recess; and a bracket assembly having a first segment that is generally cylindrical in configuration and a second, generally semi-cylindrical segment that extends from an upper portion of the first segment, said bracket assembly being adapted for mounting on the housing in a manner wherein the first segment is positioned within the inner cylindrical recess of the wheel and the second segment is positioned outwardly of the cylindrical recess to restrict the ingress of foreign material into the cylindrical recess.

2. The guard assembly as set forth in claim 1 wherein the housing includes an axle assembly having a first and second end portions and a drive mechanism mounted to each of the end portions of the axle assembly for rotation with respect thereto.

3. The guard assembly as set forth in claim 2 wherein the inner cylindrical portion of the wheel defines a mounting flange within the cylindrically shaped recess.

4. The guard assembly as set forth in claim 2 wherein the drive mechanism is a final drive assembly having a mounting flange defined thereon, each mounting flange being engageable with mounting flange defined one of a pair of wheels for rotation therewith.

5. The guard assembly as set forth in claim 4 wherein at least one sealed interface is defined between the drive mechanism and the respective end portions of the axle assembly, said sealed interface being positioned within the cylindrical recess defined by the wheel between the first segment of the bracket assembly and the mounting flange of the wheel.

6. The guard assembly as set forth in claim 2 wherein the bracket assembly further includes:

a mounting bracket having a first side;

a generally semi-cylindrical plate secured to a first side thereof;

a shroud member having a generally semi-cylindrical configuration, said shroud member being mounted to the mounting bracket in overlying relationship with respect thereto and being positioned on the mounting bracket such that at least a portion thereof is in complementary adjacent relationship to the generally semi-cylindrical plate to define the generally cylindrical segment therewith;

a first cover plate having an opening formed therein and being mounted to a second side of the mounting bracket; and a second cover plate having an opening formed therein and being mounted to the first cover plate and the shroud member, said opening of the second cover member being aligned with the opening defined by the first cover plate to define an aperture that has a size sufficient for receiving a end portion of the axle assembly therein.

7. The guard assembly as set forth in claim 6 wherein the first segment defined by the mounting bracket and shroud member is positioned within the cylindrical recess defined by the wheel and the first and second cover plates are spaced axially from the first segment and are positioned in a transverse orientation to a centerline defined by the axle assembly.

8. The guard assembly as set forth in claim 6 wherein the aperture defined by the first and second cover plates is sized such that it is only slightly larger than the axle assembly to define a space of a preselected size therebetween thereby preventing the ingress of foreign matter larger than said preselected size from entry into the cylindrical recess.

9. The guard assembly as set forth in claim 6 wherein an outer periphery of the semi-cylindrical plate mounted to the mounting bracket is defined by a radius that is slightly less than that of the cylindrical recess and is mounted on the mounting bracket in a manner to extend below the mounting bracket at a location that substantially closes off a lower portion of the cylindrical recess to restrict the entry of foreign matter into the cylindrical recess from a location beneath the mounting bracket.

10. The guard assembly as set forth in claim 6 wherein the mounting bracket is mounted to an underside of the axle assembly with the semi-cylindrical plate member positioned below the axle assembly and the shroud member positioned above the axle assembly.

11. A guard assembly, comprising:

an axle assembly having a pair of end portions, a final drive assembly mounted to each of the respective end portions for relative rotation with respect thereto;

a pair of wheels, each having a hub portion defining a generally cylindrical recess and being mounted to each final drive assembly for rotation therewith about an axis; and a bracket assembly mounted on the respective end portions of the axle assembly adjacent the respective wheels, each bracket assembly having a mounting bracket having first and second sides, said mounting bracket being mounted to the end portion of the axle assembly; a generally semi-cylindrical plate member mounted to the first side of the mounting bracket and being positioned to extend into the cylindrical recess of the adjacent hub portion, said semi-cylindrical plate member being positioned adjacent a lower portion of the cylindrical recess in concentric, closely spaced relation thereto; a shroud member having a generally semi-cylindrical configuration and first and second portions, said shroud member being mounted to the mounting bracket with the first portion thereof in complementary adjacent relationship to the semi-cylindrical plate member to define a generally cylindrical segment therewith, said shroud member being positioned with the first portion thereof within an upper portion of the adjacent cylindrical recess in concentric, closely spaced relationship thereto and the second portion thereof axially spaced from the first portion in overlying relation to the mounting bracket and the axle assembly.

12. The guard assembly as set forth in claim 11, wherein a first cover plate having an opening defined therein is mounted to the second side of the mounting plate with the end portion of the axle assembly received within the opening.

13. The guard assembly as set forth in claim 12 wherein a second cover plate having an opening defined therein is mounted to one of the first cover plate and the shroud member with the end portion of the axle assembly received within the opening, said opening of the second plate member being alignable with the opening of the first plate member to define an aperture that substantially encloses the end portion of the axle assembly to restrict the passage of foreign matter between the plate members and the axle assembly toward the hub of the wheel.

14. The guard assembly as set forth in claim 11 wherein the relative rotation between the respective final drive assemblies and the end portions of the axle assembly occurs along a sealed interface, said sealed interface being positioned within the cylindrical recess.

15. The guard assembly as set forth in claim 14 wherein the semi-cylindrical plate is positioned transversely with respect to the cylindrical recess to substantially close off the recess from a location beneath the axle assembly to restrict the ingress of foreign matter into the cylindrical recess toward the sealed interface.

16. The guard assembly as set forth in claim 13 wherein the semi-cylindrical shroud member is defined by a radius that is slightly smaller than that of the cylindrical recess and is positioned to extend axially from the cylindrical member toward the axle assembly and is secured in overlying relationship to the mounting bracket to restrict ingress of foreign matter into the cylindrical recess from an area above the axle assembly.

* * * * *